US010640265B2

(12) United States Patent
Warner

(10) Patent No.: US 10,640,265 B2
(45) Date of Patent: May 5, 2020

(54) TAMPER RESISTANT DEVICE AND METHODS OF FORMING A TAMPER RESISTANT DEVICE

(71) Applicant: Double Double D, LLC, Burlington, KY (US)

(72) Inventor: Jim F. Warner, Chicago, IL (US)

(73) Assignee: Double Double D, LLC, Burlington, KY (US)

( * ) Notice: Subject to any disclaimer, the term of this patent is extended or adjusted under 35 U.S.C. 154(b) by 357 days.

(21) Appl. No.: 15/206,646

(22) Filed: Jul. 11, 2016

(65) Prior Publication Data

US 2017/0015459 A1 Jan. 19, 2017

Related U.S. Application Data

(60) Provisional application No. 62/191,559, filed on Jul. 13, 2015.

(51) Int. Cl.

| | |
|---|---|
| ***B65D 41/34*** | (2006.01) |
| ***B65D 1/02*** | (2006.01) |
| ***B65D 55/06*** | (2006.01) |
| ***B65D 8/00*** | (2006.01) |

(52) U.S. Cl.

CPC ..... *B65D 41/3495* (2013.01); *B65D 1/0215* (2013.01); *B65D 11/04* (2013.01); *B65D 55/06* (2013.01); *B65D 2101/0007* (2013.01); *B65D 2101/0015* (2013.01); *B65D 2101/0023* (2013.01)

(58) Field of Classification Search

CPC ..... B65D 41/3457; B65D 2101/0015; B65D 2101/0092; B65D 77/06; B65D 41/3409; B65D 41/34; B65D 41/3419; B65D 41/3447

See application file for complete search history.

(56) References Cited

U.S. PATENT DOCUMENTS 2,043,226 A * 6/1936 Beider ..... B29C 65/48 215/232
2,213,932 A * 9/1940 Rehfeld ..... B65D 55/06 215/250
2,300,594 A * 11/1942 Rehfeld ..... B29C 37/0085 53/412

(Continued)

*Primary Examiner* — Andrew T Kirsch
(74) *Attorney, Agent, or Firm* — Dinsmore & Shohl LLP

(57) ABSTRACT

Tamper resistant systems and devices and methods of forming the same are disclosed. A tamper resistant system includes a container having a container body defining a cavity having a threaded opening therein, a threaded closure removably covering the threaded opening, and a frangible component including a length of material having a first end and a second end. The first end is integrated with the container body such that the frangible component and the container body have a single piece construction and the frangible component extends from the container body. The second end is coupled to the threaded closure. Subsequent removal of the threaded closure from the container causes damage to at least one of the frangible component, the threaded closure, and the container body. The frangible component, the threaded closure, and the container body are at least partially constructed of an environmentally friendly material.

11 Claims, 9 Drawing Sheets

(56) References Cited

U.S. PATENT DOCUMENTS

| | | | | | |
|---|---|---|---|---|---|
| 3,716,162 | A * | 2/1973 | Botkin | B65D 1/023 | 215/316 |
| 3,811,591 | A * | 5/1974 | Novitch | B65D 51/002 | 215/12.2 |
| 4,846,359 | A * | 7/1989 | Baird | B29C 49/22 | 215/12.2 |
| 4,993,570 | A * | 2/1991 | Julian | B65D 41/3495 | 215/252 |
| 5,511,677 | A * | 4/1996 | Oder | B65D 41/3404 | 215/230 |
| 2014/0263313 | A1 * | 9/2014 | Besic | B65D 51/2828 | 220/200 |

* cited by examiner

2 / 8

TAMPER RESISTANT DEVICE AND METHODS OF FORMING A TAMPER RESISTANT DEVICE

CROSS REFERENCE TO RELATED APPLICATION

The present application claims priority to U.S. Provisional Patent Application Ser. No. 62/191,559, filed Jul. 13, 2015 and entitled "Tamper Resistant Container," which is incorporated by reference herein in its entirety.

TECHNICAL FIELD

Embodiments described herein generally relate to a tamper resistant device and, more specifically, to a tamper resistant feature that is integrated into an environmentally friendly container.

BACKGROUND

Tamper resistance may be a desired feature for many consumables because such features allow a consumer to know the freshness of the consumable, as well as determine whether the consumable has been handled by someone post-packaging. Specifically, some consumers will not purchase a product that has been tampered and thus tamper resistance is often a desired quality for many containers. While the field of tamper resistance may be established for some containers, environmentally friendly containers lack these features.

SUMMARY

In one embodiment, a tamper resistant system includes a container having a container body defining a cavity with a threaded opening therein, a threaded closure removably covering the threaded opening, and a frangible component including a length of material having a first end and a second end. The first end is integrated with the container body such that the frangible component and the container body have a single piece construction and the frangible component extends from the container body. The second end is coupled to the threaded closure. Subsequent removal of the threaded closure from the container causes irreversible damage to at least one of the frangible component, the threaded closure, and the container body. The frangible component, the threaded closure, and the container body are at least partially constructed of an environmentally friendly material.

In another embodiment, a tamper resistant device includes a frangible component having a first end and a second end. The first end is integrated with a container body such that the frangible component and the container body have a single piece construction and the frangible component extends from the container body. The second end is coupled to a threaded closure when the threaded closure is secured on the container body. Subsequent removal of the threaded closure from the container body causes irreversible damage to at least one of the frangible component, the threaded closure, and the container body. The frangible component is constructed of an environmentally friendly material.

In yet another embodiment, a tamper resistant device includes a frangible component having a first end and a second end. The first end is integrated with a threaded closure such that the frangible component and the threaded closure have a single piece construction and the frangible component extends from the threaded closure. The second end is coupled to a container body when the threaded closure is secured on the container body. Subsequent removal of the threaded closure from the container body causes irreversible damage to at least one of the frangible component, the threaded closure, and the container body. The frangible component is constructed of an environmentally friendly material.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Figure 1:
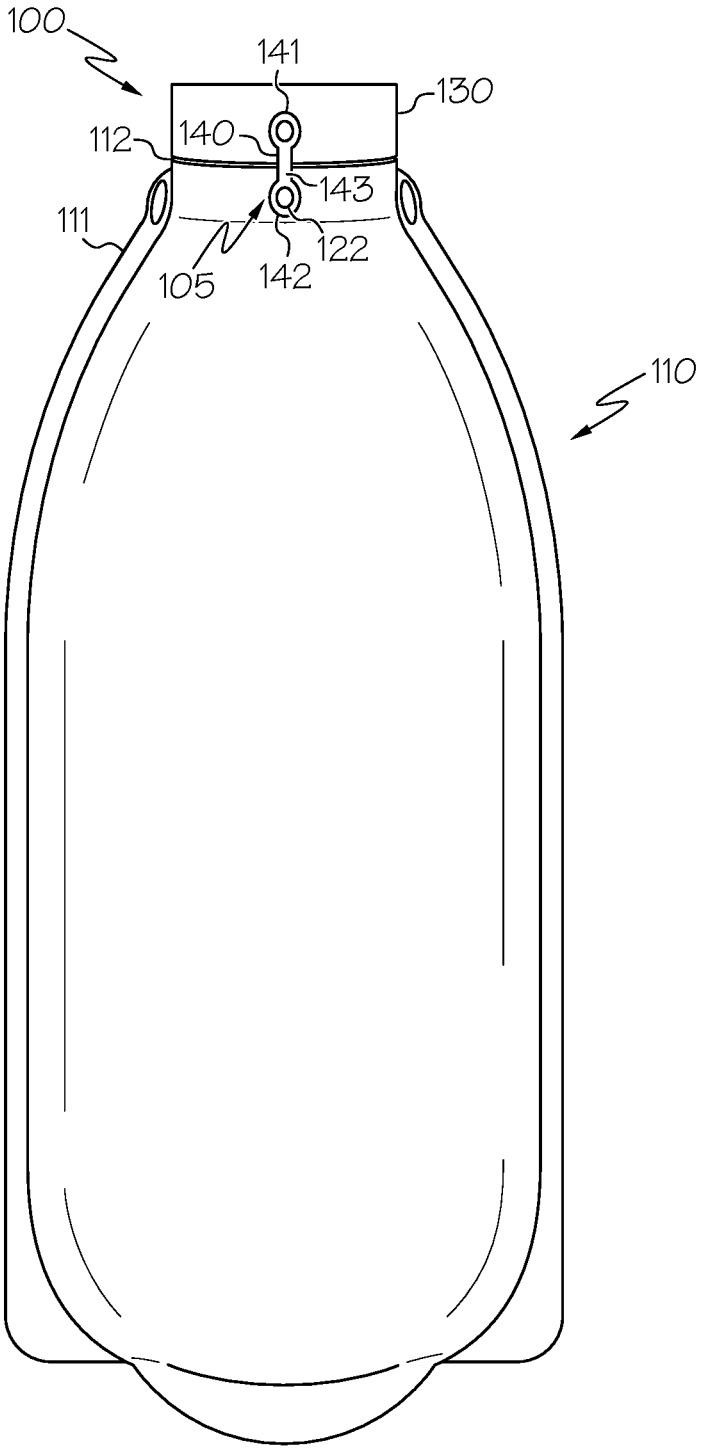
FIG. 1 schematically depicts a front view of an illustrative environmentally friendly tamper resistant system according to one or more embodiments shown and described herein.

Embodiments disclosed herein relate to a tamper resistant system that includes environmentally friendly materials and methods of forming the same. Some embodiments include a tamper resistant device (e.g., a seal, a frangible component, and/or the like) that is integral to an environmentally friendly container or a closure therefor. The tamper resistant device may be molded as an extension of one or more portions of the environmentally friendly container and/or attached to one or more portions of the environmentally friendly container. When the closure of the environmentally friendly container is opened, the tamper resistant portion may become irreversibly damaged and/or detach from the environmentally friendly container, thereby indicating that the environmentally friendly container has been opened. In some embodiments, the tamper resistant portion may be damaged, but may be reattached to the container. As an example, a color change may occur to the tamper resistant portion, when detached, but the tamper resistant portion may be reattached. Thus, a user may easily confirm whether the container has been tampered, but allow additional security when re-closing the container. The tamper resistant system will be described in more detail below.

Some tamper resistant devices are difficult for users to discern whether tampering has occurred (e.g., determine whether a tamper resistant ring has detached from a closure). In addition, materials formed of plastics or the like are difficult for a user to break to remove the closure, malfunction such that a frangible component remains intact when the closure is removed, contain materials that are harmful to the environment (e.g., non-environmentally friendly materials), result in sharp/jagged edges that can cause injury, are easily defeated, are only suitable for particular applications (e.g., closures require tools for removal), contain adhesives that fail, and/or are not physically attached to a closure.

As used herein, the term "environmentally friendly" generally encompasses components, materials, and/or the like that have a reduced potential environmental impact with respect to non-environmentally friendly components, materials, and/or the like. For example, "environmentally friendly" materials generally have a low toxicity to plants and animals, do not contain or contain minimal amounts (e.g., less than 1% by mass) of volatile organic compounds (VOCs) such as aliphatic hydrocarbons, aromatic hydrocarbons, ethyl acetate, glycol ethers, ketone-based solvents such as acetone and methylethyl ketones, and alcohols, do not cause greenhouse gas emissions in their production, do not contribute to ozone layer depletion, and/or the like. Environmentally friendly materials as used herein are generally reusable, recyclable, biodegradable, and/or do not excessively contribute to overfilling of landfills. Biodegradable materials generally contain one or more biodegradable compounds that are at least partially decomposed by microorganisms in the soil, manure, compost, and/or the like.

Illustrative examples of environmentally friendly materials include, but are not limited to, agricultural processing materials, such as forms of sugarcane (bagasse), bamboo, wheat straw, banana leaves, hay, grasses, cornstalks, recycled pulp, fiber materials, and/or the like. Other illustrative environmentally friendly materials may include, but are not limited to, post-consumer waste, such as newsprint, packaging, other forms of paper products, and/or the like that may or may not have been recycled and/or repurposed for a particular application as described herein. Yet other illustrative environmentally friendly materials may include, but are not limited to, composite materials, such as materials obtained from landfill and/or municipal reclaim centers, including architectural wood, building materials, manufacturing byproducts, and/or the like. It should be understood that one or more other environmentally friendly materials not specifically described herein may also be used without departing from the scope of the present disclosure. Environmentally friendly materials may also be known as "green" or "eco-friendly" materials, as such terms are generally used.

Embodiments described herein may be used with an environmentally friendly multi-barrier container (e.g., a multi-barrier bottle). Embodiments that utilize a multi-barrier configuration may include a plurality of layers of barrier material, including an outer barrier layer and an inner barrier layer formed from a preform. A barrier material may include any material that is used to form a gas barrier from the gases that are used when forming a bottle from the preform. In addition, the barrier material may also include any material that is used to form a gas barrier for the eventual contents of the resulting bottle (e.g., a bottle filled with carbonated drinks contains carbon dioxide). Other embodiments are also contemplated.

Referring now to the drawings, FIG. 1 schematically depicts a front view of an illustrative environmentally friendly tamper resistant system 100 according to one or more embodiments shown and described herein. The tamper resistant system 100 includes a container 110, a closure 130, and a tamper resistant device 105 that includes a frangible component 140. The tamper resistant system 100 is constructed and arranged to indicate whether the closure 130 has been separated from the container 110 (and thus tampered with) since the container 110 was filled and closed with the closure 130. That is, the tamper resistant device (e.g., the frangible component 140 coupled to or integrated with the container 110 and the closure 130) is constructed and arranged to provide such an indication of whether the closure 130 has been separated from the container 110. As will be described in greater detail herein, the frangible component 140 is constructed such that it cannot be removed without being damaged and the closure 130 cannot be removed from the container 110 without damaging at least the frangible component 140.

The container 110 includes a container body 111 defining an internal cavity therein. The internal cavity may be accessed by at least one opening (e.g., a threaded opening) in the container body 111, each of which is removably covered by the closure 130. While the present disclosure relates to a single closure 130 and/or a single opening in the container body 111, it should be understood that a plurality of closures covering a plurality of openings in the container body 111 are contemplated and included within the scope of the present disclosure.

In some embodiments, the container 110 may also include a notch 122. The notch 122 may provide a location for attachment of a portion of the frangible component 140. The notch 122 may be formed as a component of the container 110 in a single piece construction such that the notch 122 protrudes outwardly from the container body 111. In some embodiments, the notch 122 may not be part of a single piece construction, but rather may be glued, welded, and/or otherwise coupled to the container body 111. In some embodiments, the notch 122 may be formed with a flange thereon so as to secure the frangible component 140 on the notch 122 and prevent removal of the frangible component 140 from the notch 122.

The location of the notch 122 on the container 110 is generally such that the frangible component 140 can extend from the notch 122 to the closure 130. For example, the notch 122 may be located at or near a neck 112 of the container 110. However, other locations should be understood and such locations are included within the scope of the present disclosure.

The closure 130 may be configured to removably cover the opening on the container body 111 such that, when the closure 130 is installed, the contents of the container body 111 cannot escape. In some embodiments, the closure 130 may be a threaded closure, such as a screw on cap or the like. As such, the closure 130 may contain threads on an internal surface thereof that correspond to threads on an external surface of the container body 111, such as the neck 112 of the container body (e.g., the neck 112 defining a threaded opening). Accordingly, the closure 130 can be screwed on or off of the container 110 by twisting the closure in a clockwise or counterclockwise direction. It will be understood that while a screw cap is depicted in FIG. 1, the closure 130 is not limited by this depiction.

The closure 130 may be constructed of one or more materials, particularly environmentally friendly materials, such as, for example, the environmentally friendly materials previously described herein. In some embodiments, the closure 130 may be constructed of a single environmentally friendly material. In other embodiments, an interior portion of the closure 130 may be constructed of a first material and an exterior portion of the closure 130 may be constructed of a second material. For example, the interior portion of the closure 130 may be constructed of a polymer material to create a liquid seal with the container body 111 and the exterior portion of the closure 130 may be constructed of an environmentally friendly material. In some embodiments, the material used for at least a portion of the closure 130 may be the same material used for the frangible component 140, such as in embodiments where the frangible component 140 is integrated with the closure 130, as described in greater detail herein.

The frangible component 140 is generally a length of material that extends from a portion of the closure 130 to a portion of the container 110. For example, the frangible component 140 may include a closure-contacting end 141 (e.g., a first end) and a container-contacting end 142 (e.g., a second end) that contact the closure 130 and the container 110, respectively, when the frangible component 140 is fully installed, as described herein. It should be understood that the terms "first end" and "second end" are merely descriptive, and may be used to describe either the closure-contacting end 141 or the container-contacting end 142 herein.

In addition to the closure-contacting end 141 and the container-contacting end 142, the frangible component 140 may further include a frangible portion 143. The frangible portion 143 is a portion that is easily deformed (e.g., broken, torn, etc.) when a particular force is applied thereto. For example, the frangible portion 143 may be deformed when the closure 130 is removed from the container 110, thereby causing a torsional force or the like on at least a portion of the frangible portion 143. The frangible portion 143 may be located on any portion of the frangible component 140, such as between the closure-contacting end 141 and the container-contacting end 142, as a portion of the closure-contacting end 141, and/or as a portion of the container-contacting end 142. In some embodiments, the entire frangible component 140 may be easily deformed when certain forces are applied thereto.

The closure-contacting end 141 of the frangible component 140 contacts the closure 130 at least when the closure 130 is initially placed on the container 110 such that the closure-contacting end 141 is integrated with the closure 130 or coupled to the closure 130. Similarly, the container-contacting end 142 of the frangible component 140 contacts the container 110 at least when closure 130 is initially placed on the container 110 such that the container-contacting end 142 is integrated with the container 110 or coupled to the container 110.

The frangible component 140 may generally be constructed of one or more materials, and thus the materials used for constructing the frangible component 140 are not limited by this disclosure. In some embodiments, the frangible component 140 may be constructed of similar materials as used for one or more of the other components described herein, including the container 110 (and/or components thereof) and the closure 130. In some embodiments, the frangible component 140 may be constructed of a material that is easily deformed to indicate tampering, as described herein. In some embodiments, the frangible component 140 may be constructed of an environmentally friendly material.

Similarly, in some embodiments, the frangible component 140 may be constructed of a plurality of different colored materials to further provide an indicator of tampering. For example, the frangible component 140 may be constructed of a first colored material in a core portion and a second colored material completely surrounding the core portion of first colored material (e.g., a cladding) such that the first colored material is not visible when the frangible component 140 is not deformed. However, when the frangible component 140 is deformed as described herein, the core portion may become visible, thereby showing the first color and providing another visual indicator of tampering.

While only a single frangible component 140 is depicted herein, it should generally be understood that the tamper resistant device 105 may include a plurality of frangible components 140 without departing from the scope of the present disclosure. In one nonlimiting example, the tamper resistant device 105 may include two or more frangible components 140 spanning between a single closure 130 and a single container 110. In another nonlimiting example, the tamper resistant device 105 may include one or more frangible components 140 spanning between a container 110 and each of a plurality of closures 130.

Figure 2A:
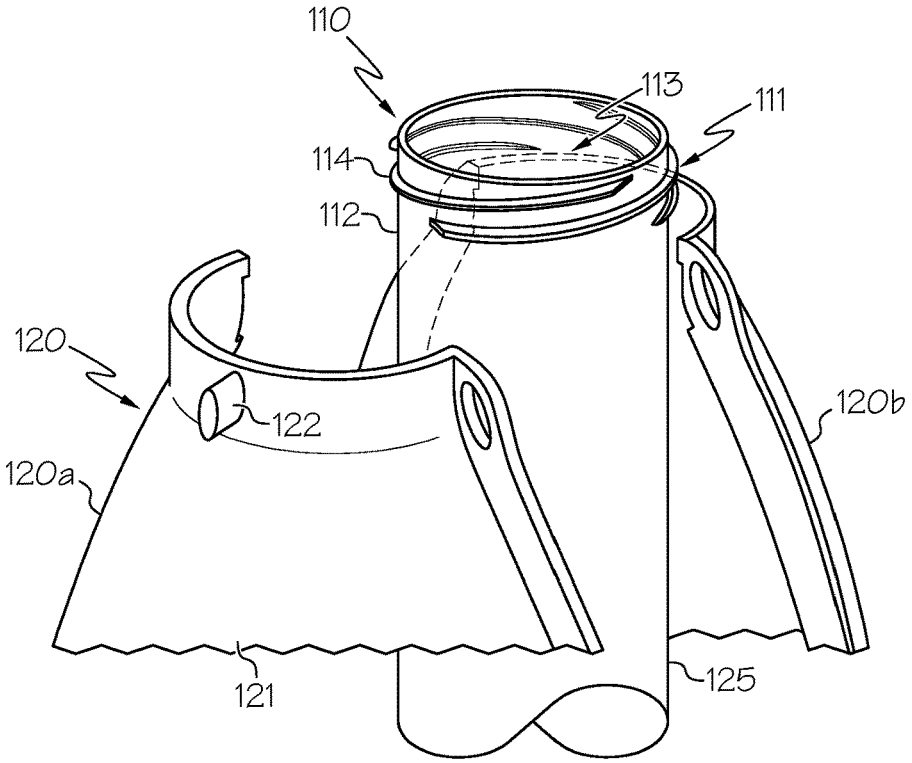
FIG. 2A schematically depicts an exploded view of a portion of an illustrative environmentally friendly tamper resistant container according to one or more embodiments shown and described herein.
Figure 2B:
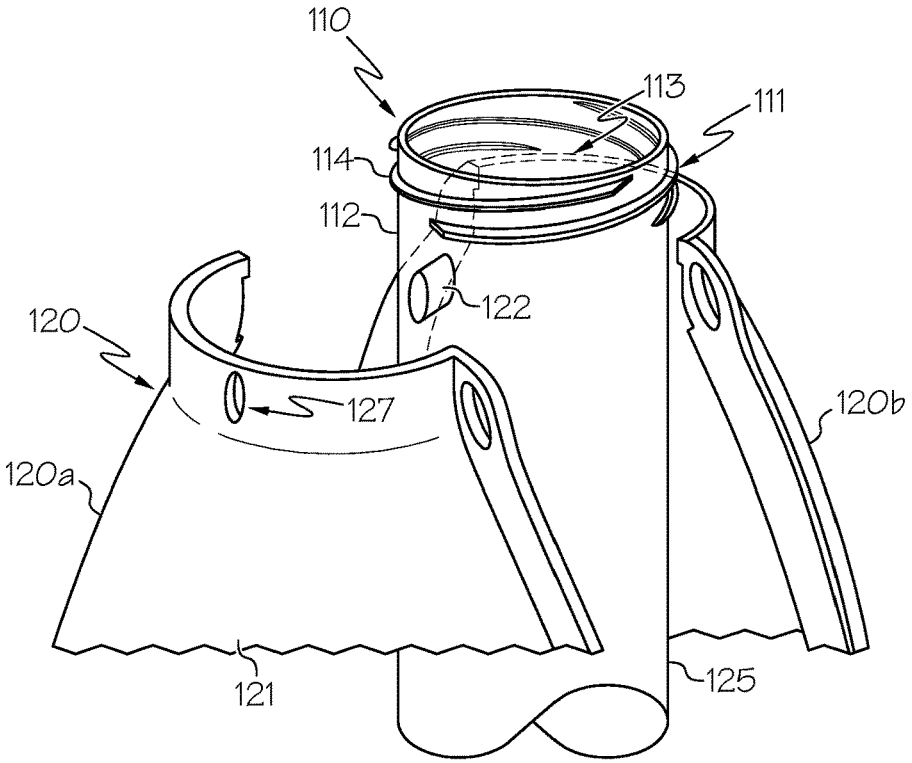
FIG. 2B schematically depicts an exploded view of a portion of another environmentally friendly tamper resistant container according to one or more embodiments shown and described herein.

FIGS. 2A and 2B schematically depict exploded views of a portion of an illustrative environmentally friendly tamper resistant container 110 according to one or more embodiments shown and described herein. As shown in FIGS. 2A and 2B, the container 110 generally includes the container body 111 defining an opening 113 therein. As illustrated, the container body 111 includes at least an exterior barrier 120 (e.g., a first barrier) and an interior barrier 125 (e.g., a second barrier). The exterior barrier 120 may include one or more walls 121 and may be coupled to the interior barrier 125 to define a cavity. As such, the exterior barrier 120 may generally surround at least a portion of the interior barrier 125. In some embodiments, the exterior barrier 120 may surround at least a portion of the interior barrier 125. For example, the entirety of the interior barrier 125 except for the neck 112 thereof may be surrounded by the exterior barrier 120.

Some embodiments of the exterior barrier 120 may be created from a single piece of material. That is, the exterior barrier 120 may be particularly formed as a one piece component. For example, the exterior barrier 120 may be formed by molding (e.g., injection molding, compression molding, blow molding, or the like), extruding (e.g., extrusion molding), sculpting, blowing, or the like into a single piece unit. In some embodiments, the single piece of the exterior barrier 120 may be wrapped and seamed to create an enclosure defined by the exterior barrier 120. In other embodiments, the exterior barrier 120 may be created by joining a plurality of pieces together at a plurality of seams. For example, the exterior barrier 120 may be formed by fusing a first piece 120*a* to a second piece 120*b*.

The exterior barrier 120 may be constructed of an environmentally friendly material, such as the environmentally materials previously described herein. The interior barrier 125 may be constructed of a polymer material or the like, particularly materials that are capable of being blow molded and/or extruded. In some embodiments, the interior barrier 125 may be a preform, and thus may be constructed of materials that are used for preforms, particularly bottle preforms. Illustrative materials may include, but are not limited to, PET and its copolyesters. Other illustrative materials may include polyether block amides (e.g., PEBAX), nylons, polyurethanes, polyethylenes (e.g., high density polyethylenes (HDPE), ultra-high-molecular-weight polyethylenes (UHWPE), low density polyethylenes (LDPE), or any combination thereof), biaxially-oriented polyethylene terephthalates (e.g., mylar), and other polymers and thermoplastic polymers, fabrics, silicones such as silicone rubber, latex, glass, or other materials now known or later developed.

The interior barrier 125 may be particularly sized and/or shaped such that the interior barrier 125 can fit within a volume defined by an interior surface of the exterior barrier 120. In some embodiments, the interior barrier 125 may fit within the volume defined by the exterior barrier 120 such that at least a portion of the frangible component 140 (FIG. 1) is securely retained between the interior barrier 125 and the exterior barrier 120, as described herein. In embodiments where the interior barrier 125 is a preform, the size and shape may generally correspond to typical preform shapes and/or sizes prior to forming the bottle from the preform. Other sizes and/or shapes of the interior barrier 125 should generally be understood.

In the embodiment shown in FIG. 2A, the exterior barrier 120 may have the notch 122 integrated therewith or coupled thereto. As such, the notch 122 may be formed with the exterior barrier 120 as a single piece construction or may be permanently attached to the exterior barrier 120, as described herein. In embodiments where the notch 122 is formed as a single piece construction with the exterior barrier 120, the notch may also be constructed of environmentally friendly materials.

In some embodiment shown in FIG. 2B, the notch 122 may be integrated with or coupled to the interior barrier 125 instead of the exterior barrier 120. More specifically, the notch 122 may be integrated as a single piece with the interior barrier 125 or may be permanently attached to the interior barrier 125, as described herein. In embodiments where the notch 122 is integrated as a single piece construction with the interior barrier 125, the notch 122 may be formed from the same (or similar) materials as the interior barrier 125. The notch 122 may be formed to protrude outwardly from a surface of the interior barrier 125. In addition, when the container 110 is formed as described herein, the notch 122 may extend through a corresponding opening 127 in the wall 121 of the exterior barrier 120.

In some embodiments, the notch 122 may be frangible such that the notch 122 breaks away from the container 110 when a force is applied thereto, such as, for example, when the closure 130 (FIG. 1) is removed from the container, as described herein. In such embodiments, the notch 122 may be coupled to the exterior barrier 120 and constructed of a frangible material, such as one of the environmentally friendly materials described herein. In other embodiments, the notch 122 may be rigidly constructed so that the notch 122 does not disconnect from the container 110 when a force is applied thereto. In such embodiments, the notch 122 may be coupled to the interior barrier 125 and constructed of a secure material, such as the materials for constructing the interior barrier 125 described herein.

Figure 3:
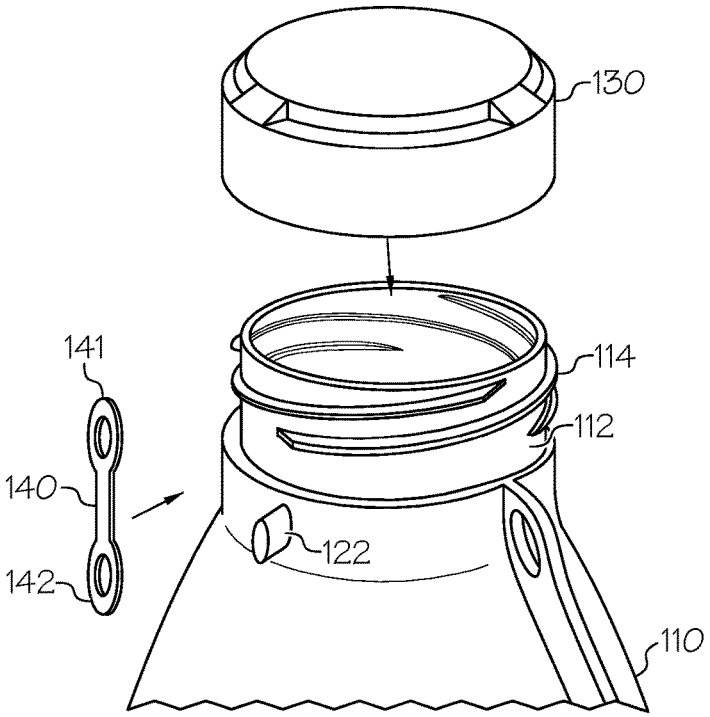
FIG. 3 schematically depicts an exploded side view of a portion of an illustrative environmentally friendly tamper resistant container according to one or more embodiments shown and described herein.

FIG. 3 schematically depicts an exploded side view of a portion of an illustrative environmentally friendly tamper resistant container 110 according to one or more embodiments shown and described herein. As shown in FIG. 3, installation of the closure 130 may include placing the closure 130 on the container 110 (e.g., by twisting a threaded portion of the closure 130 onto a corresponding threaded portion 114 of the container 110). In addition, the frangible component 140 is coupled to the closure 130 and the container 110, as described in greater detail herein. As such, the closure 130 cannot be removed again without causing irreversible damage to at least one of the closure 130, the container 110, and the frangible component 140, as described herein. Accordingly, such assembly ensures to a user that if no damage has occurred, the container 110 has not been tampered with (e.g., opened since it was originally closed by a manufacturer, a bottler, etc.).

As previously described herein, the frangible component 140 can be integrated with or coupled to the closure 130. In addition, the frangible component 140 can be integrated with or coupled to the container 110. FIGS. 4A-4E and 5 depict illustrative examples of how the frangible component 140 may be coupled or integrated.

Figure 4A:
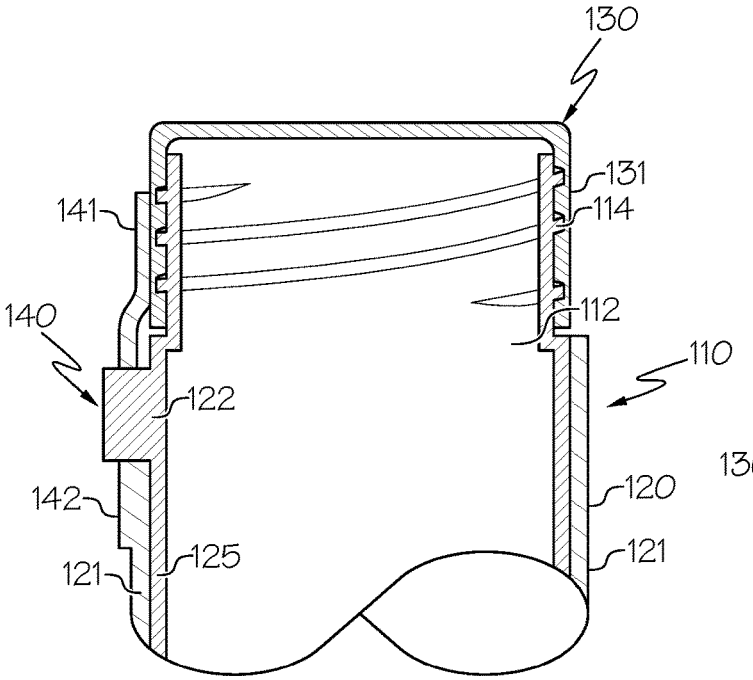
FIG. 4A schematically depicts a sectional side view of an illustrative frangible component configuration according to one or more embodiments shown and described herein.
Figure 4B:
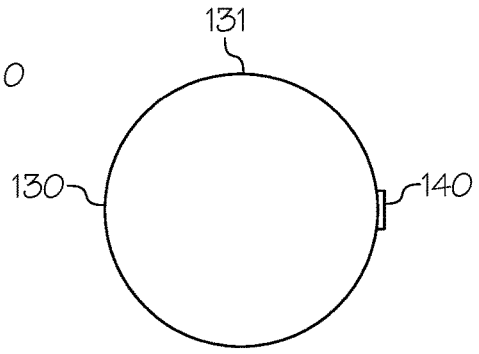
FIG. 4B schematically depicts a top view of an illustrative frangible component configuration according to one or more embodiments shown and described herein.

FIGS. 4A-4B schematically depict a sectional side view and a top view, respectively, of an illustrative frangible component configuration according to one or more embodiments shown and described herein. In some embodiments, the closure-contacting end 141 of the frangible component 140 may be coupled to an exterior surface 131 of the closure 130. For example, the closure-contacting end 141 of the frangible component 140 may be formed as non-removable part on the exterior surface 131 of the closure 130. In another example, the closure-contacting end 141 of the frangible component 140 may be attached to the exterior surface 131 of the closure 130 via any means of attachment, including attachment hardware or the like.

In various embodiments, the closure-contacting end 141 of the frangible component 140 may be attached to any portion of the closure 130 with an adhesive. For example, an adhesive may be applied to the closure-contacting end 141 and/or the closure 130 such that, when the closure-contacting end 141 and the closure 130 are contacted together, they cannot be detached without causing irreversible damage, as described in greater detail herein. While FIGS. 4A and 4B depict the closure-contacting end 141 coupled via the adhesive to the exterior surface 131 of the closure 130, the present disclosure is not limited to such. That is, in some embodiments, the closure-contacting end 141 may be coupled between an interior portion and an exterior portion of the closure 130 via the adhesive or may be coupled to an interior surface of the closure 130 via the adhesive. The adhesive is not limited by this disclosure, and can include any material that is generally understood to be able to fasten or join two other materials together. Nonlimiting examples of adhesives include epoxy resins, glue gums, cementing agents, and/or the like.

As particularly shown in FIG. 4A, the container-contacting end 142 of the frangible component 140 may be coupled to an exterior surface of the container 110, such as the wall 121 of the exterior barrier 120. In one nonlimiting example, the container-contacting end 142 of the frangible component 140 may be formed as non-removable part on the exterior surface of the container 110. In another nonlimiting example, the container-contacting end 142 may be attached to the exterior surface of the container 110 via any means of attachment, including attachment hardware or the like. In yet another nonlimiting example, the container-contacting end 142 of the frangible component 140 may include a loop or the like that slips around the notch 122 formed in the container 110, as described in greater detail herein. To prevent the loop from being removed from the notch 122, the notch may incorporate, for example, a flange or the like (e.g., a flanged end) that prevents removal of the frangible component 140 from the notch 122 once it has been secured.

In various embodiments, the container-contacting end 142 of the frangible component 140 may be attached to any portion of the container 110 with an adhesive. For example, an adhesive may be applied to the container-contacting end 142 and/or the container 110 (or a portion thereof) such that, when the container-contacting end 141 and the container 110 are contacted together, they cannot be detached without causing irreversible damage, as described in greater detail herein. The container-contacting end 142 may be coupled to any portion of the container 110 via the adhesive, including, but not limited to, the container-contacting end 142 adhered to an exterior surface of the exterior barrier 120, the container-contacting end 142 adhered between the exterior barrier 120 and the interior barrier 125, or the container-contacting end 142 adhered to an interior surface of the interior barrier 125. As previously described herein, the adhesive is not limited by this disclosure, and can include any material that is generally understood to be able to fasten or join two other materials together.

In other embodiments, the container-contacting end 142 of the frangible component 140 may be integrated with the container 110 (or a portion thereof, such as the exterior barrier 120) such that the container 110 and the frangible component 140 are formed as a single piece. That is, the frangible component 140 may be formed from the same material as the container 110 (or the portion thereof) such that it extends a distance away from the container body 111 and can be coupled to the closure 130. In some embodiments, the frangible component may be integrated with the notch 122 such that the notch 122 and the frangible component 140 are a single piece. Such embodiments may be particularly used where the notch 122 is frangible and can be removed from the container body 111 as described herein.

Figure 4C:
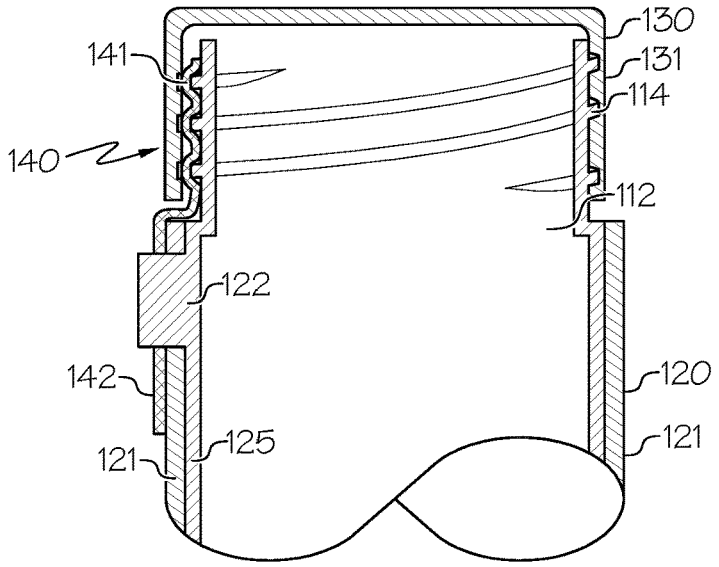
FIG. 4C schematically depicts a sectional side view of another illustrative frangible component configuration according to one or more embodiments shown and described herein.
Figure 4D:
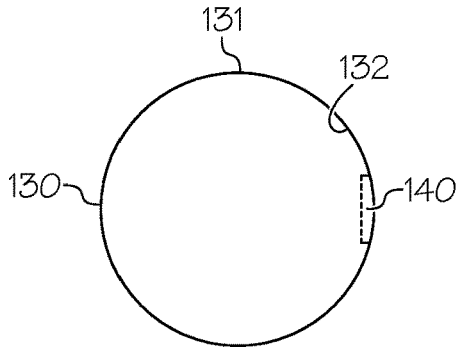
FIG. 4D schematically depicts a top view of another illustrative frangible component configuration according to one or more embodiments shown and described herein.

FIGS. 4C and 4D schematically depict a sectional side view and a top view, respectively, of a portion of another illustrative frangible component configuration according to one or more embodiments shown and described herein. In such embodiments, the closure-contacting end 141 of the frangible component 140 may be coupled to an interior surface 132 of the closure 130. For example, the closure-contacting end 141 may be formed as a non-removable part on the interior surface 132 of the closure 130 or permanently attached to the interior surface 132 of the closure 130. In another example, the closure-contacting end 141 may be placed between the interior surface 132 of the closure 130 and an exterior surface of the container 110 such that when the closure 130 is secured on the container 110, the closure-contacting end 141 is secured between the closure 130 and the container 110 (i.e., the corresponding threaded portions on the closure 130 and the container 110 hold the closure-contacting end 141 therebetween).

Figure 4E:
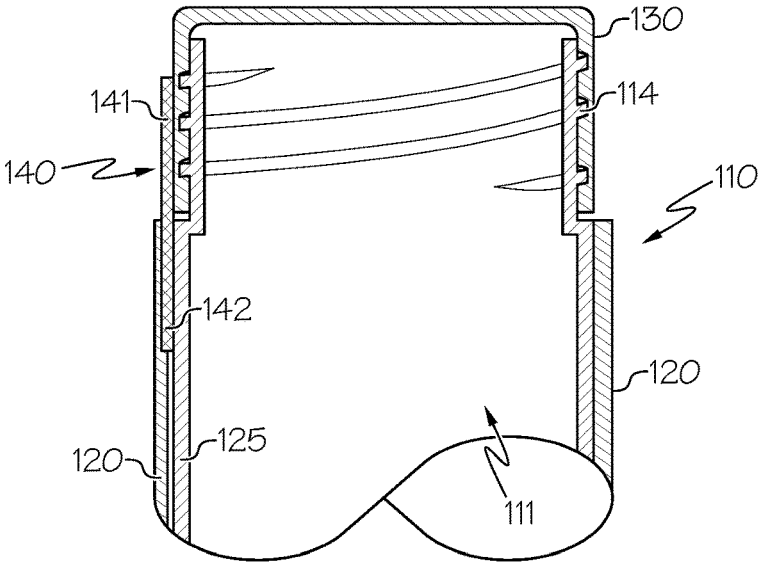
FIG. 4E schematically depicts a sectional side view of yet another illustrative frangible component configuration according to one or more embodiments shown and described herein.

FIG. 4E schematically depicts a sectional side view of yet another illustrative frangible component configuration according to one or more embodiments shown and described herein. In such embodiments, the container-contacting end 142 of the frangible component 140 may be coupled between the interior barrier 125 and the exterior barrier 120 of the container 110 such that, when formed, the exterior barrier 120 and the interior barrier 125 retain the container-contacting end 142 of the frangible component 140 therebetween.

Since the frangible component 140 is coupled between the exterior barrier 120 and the interior barrier 125 of the container 110 according to FIG. 4E, a notch may not be necessary. As such, a notch may not be formed on the container 110 according to the embodiment depicted in FIG. 4E.

Figure 5:
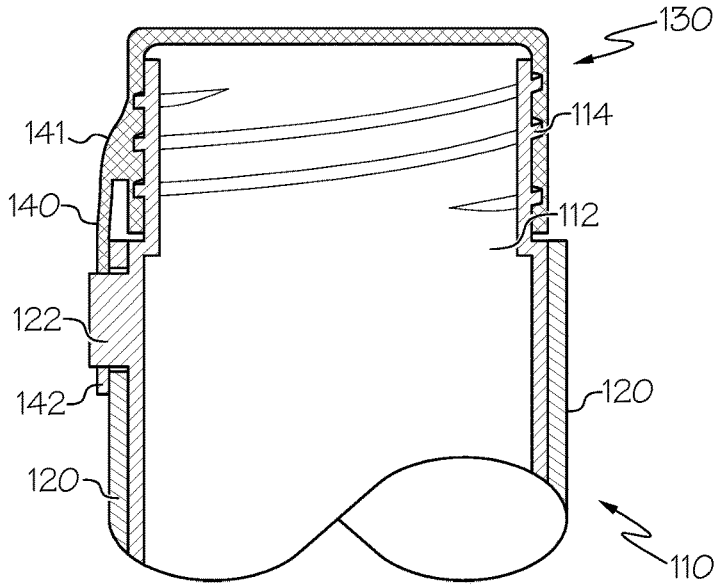
FIG. 5 schematically depicts a sectional side view of yet another illustrative frangible component configuration according to one or more embodiments shown and described herein.

FIG. 5 schematically depicts a sectional side view of yet another illustrative frangible component configuration according to one or more embodiments shown and described herein. In such embodiments, the closure-contacting end 141 may be integrated with the closure 130 such that the closure 130 and the frangible component 140 are formed as a single piece. That is, the frangible component 140 may be formed such that it extends a distance away from the closure 130 and can be coupled to a different portion of the container 110 than portions that contact and couple with the closure 130.

It should be understood that the various configurations of the frangible component 140 according to FIGS. 4A-4E are merely illustrative. As such, other configurations, as well as other combinations of the configurations described herein, are included within the scope of the present disclosure.

Figure 6A:
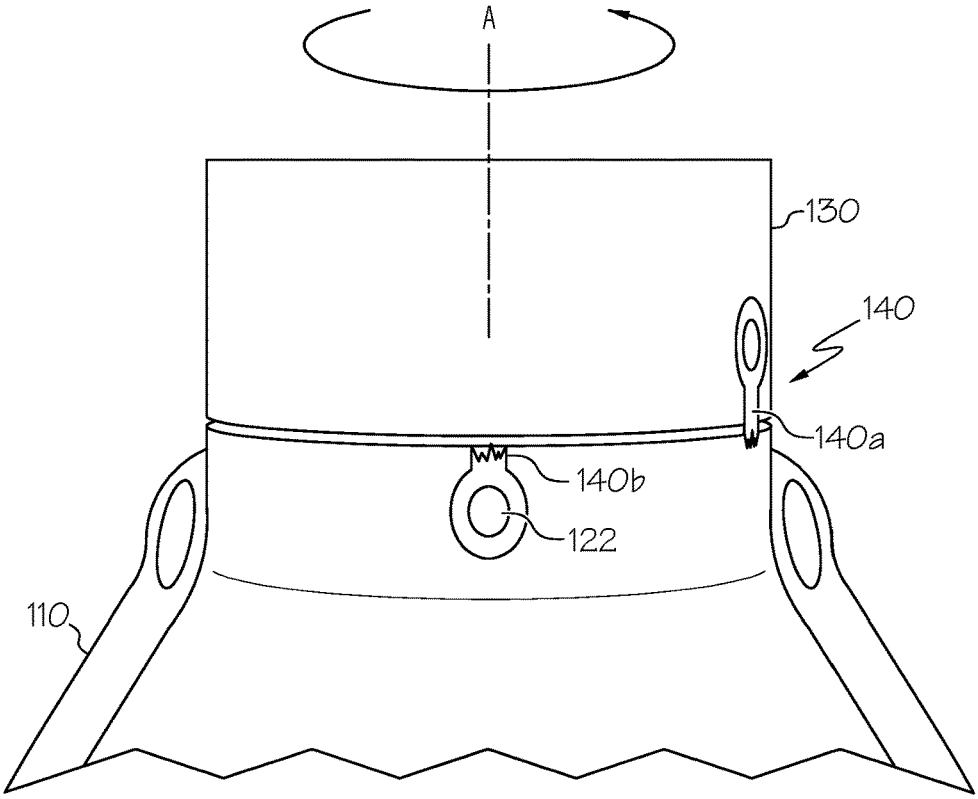
FIG. 6A schematically depicts an illustrative damaged frangible component of an environmentally friendly tamper resistant container according to one or more embodiments shown and described herein.
Figure 6B:
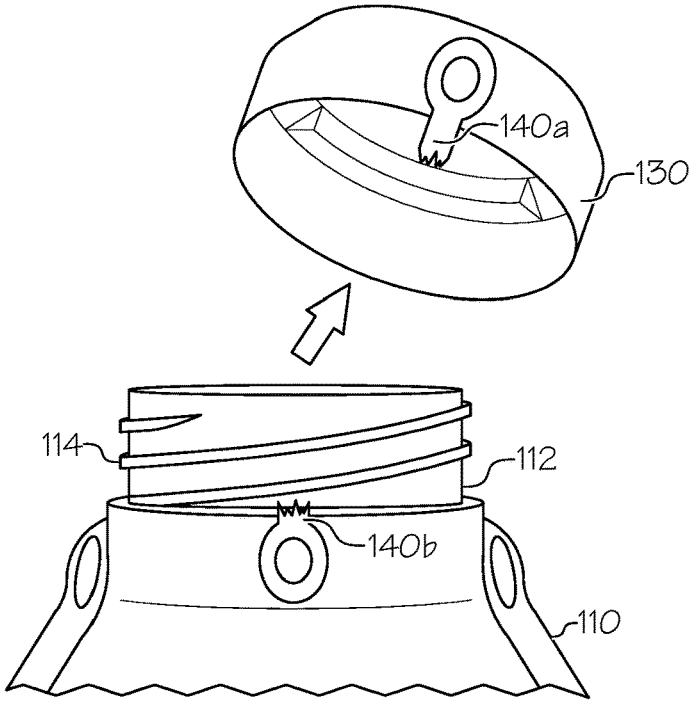
FIG. 6B schematically depicts removal of an illustrative closure portion and an illustrative damaged frangible component according to one or more embodiments shown and described herein.
Figure 6C:
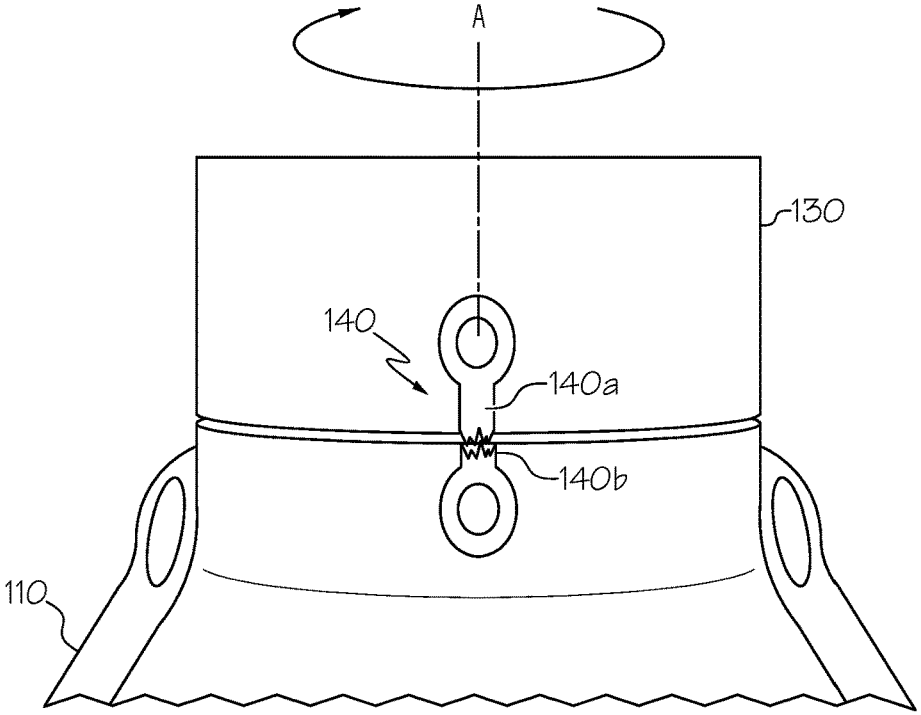
FIG. 6C schematically depicts replacement of an illustrative closure portion after an illustrative frangible component has been damaged according to one or more embodiments shown and described herein.

FIG. 6A schematically depicts an illustrative damaged frangible component of an environmentally friendly tamper resistant container, FIG. 6B schematically depicts removal of an illustrative closure portion and an illustrative damaged frangible component, and FIG. 6C schematically depicts replacement of an illustrative closure portion after an illustrative frangible component has been damaged according to one or more embodiments shown and described herein.

More specifically, FIGS. 6A-6C depict damage to the frangible component 140 upon removal of the closure 130 from the container 110. For example, as shown in FIGS. 6A and 6B, the closure 130 (which is a threaded closure as described herein) is twisted in a counterclockwise direction around a center axis A relative to the container 110 and removed from the container 110, thereby irreversibly damaging at least a portion of the frangible component 140 by tearing the frangible component 140. As a result, a first portion 140*a* of the frangible component 140 remains attached to the closure 130 and a second portion 140*b* of the frangible component 140 remains attached to a portion of the container 110 (e.g., the notch 122). The damage to the frangible component 140 is irreversible in the sense that if the closure 130 is placed back on the container 110 (e.g., twisted in a clockwise direction around the center axis A relative to the container 110), the first portion 140*a* still remains detached from the second portion 140*b*, as shown in FIG. 6C.

Figure 7:
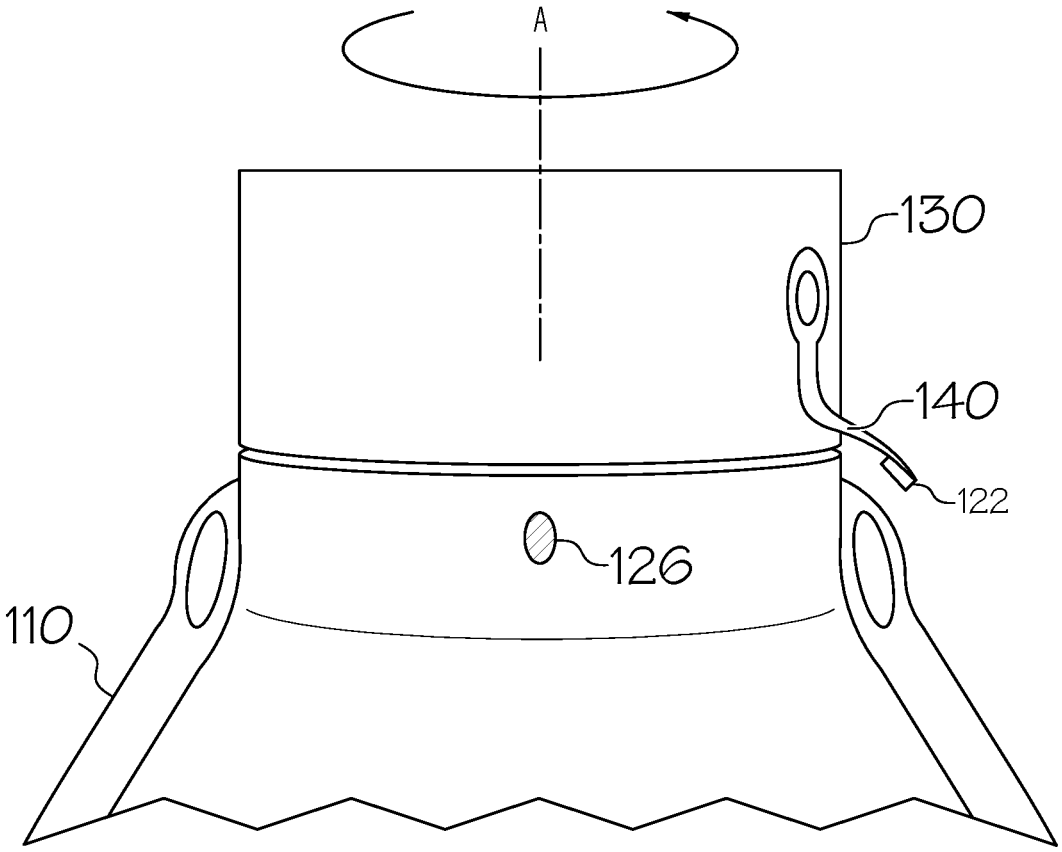
FIG. 7 schematically depicts an illustrative damaged notch on an environmentally friendly tamper resistant container according to one or more embodiments shown and described herein.

It should be understood that other portions of the container 110, the closure 130, and/or the frangible component 140 may become irreversibly damaged upon removal of the closure 130 from the container 110. For example, FIG. 7 schematically depicts an illustrative damaged notch on an environmentally friendly tamper resistant container according to one or more embodiments shown and described herein. As shown in FIG. 7, removal of the closure 130 from the container 110 may cause the notch 122 to detach from the container 110 (i.e., becoming irreversibly damaged) when the closure 130 is twisted in a counterclockwise direction around the center axis A relative to the container 110. In some embodiments, a location of the previous attachment of the notch 122 to the container 110 may contain an indicator 126 or the like that provides a visual indication that the notch 122 has been removed, thereby indicating potential tampering of the container 110. For example, the indicator 126 may be a differently colored material than at least a surrounding area of the container 110. In another example, the indicator 126 may be a hole, a recess, or the like where the notch 122 was previously located.

Figure 8:
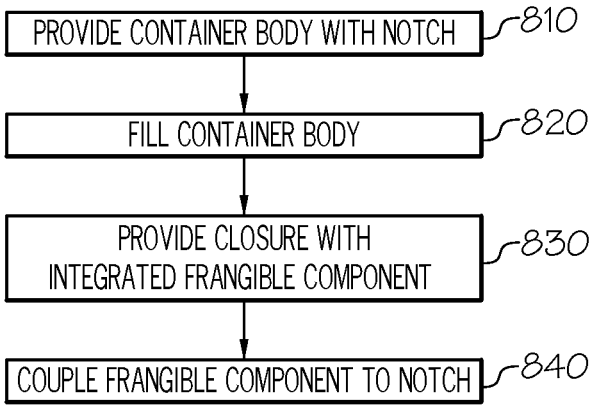
FIG. 8 depicts a flow diagram of a first illustrative method of forming and filling an environmentally friendly tamper resistant container according to one or more embodiments shown and described herein.

The container 110 may be filled, closed, and integrated with the tamper resistant devices via one or more methods, which may depend on the particular configuration of the frangible component 140 as described herein. For example, FIG. 8 depicts a flow diagram of a first illustrative method of forming and filling an environmentally friendly tamper resistant container according to one or more embodiments shown and described herein. As shown in FIG. 8, a method may include providing a container body for an environmentally friendly container with a notch at step 810. The container body may generally be constructed with the notch integrated therewith, as described in greater detail herein.

At step 820, the container body may be filled with any contents. For example, the container body may be filled with a food item, a beverage, a drug, a chemical composition, a beauty product, a toiletry item, or the like. Other components may be used to fill the container body according to step 820 without departing from the scope of the present disclosure.

At step 830, a closure having an integrated frangible component may be provided. The closure may be any one of the closures described herein that has the frangible component permanently attached thereto. Thus, the closure that is provided at step 830 may be a closure that has a frangible component attached to an outside surface thereof, a frangible component attached to an inside surface thereof, or a closure that is formed as a single piece with the frangible component, as described herein.

At step 840, the closure may be attached to the container and the frangible component may be coupled to the notch on the container body by attaching the frangible component to the notch. For example, a loop in the frangible component may be slipped around the notch. In some embodiments, a flange may be formed after the frangible component is attached to the notch so as to prevent subsequent removal and replacement of the frangible component around the notch.

Figure 9:
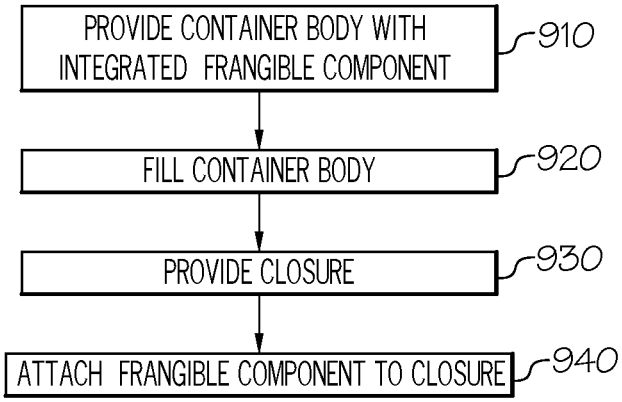
FIG. 9 depicts a flow diagram of a second illustrative method of forming and filling an environmentally friendly tamper resistant container according to one or more embodiments shown and described herein.

FIG. 9 depicts a flow diagram of a second illustrative method of forming and filling an environmentally friendly tamper resistant container according to one or more embodiments shown and described herein. In the steps described herein with respect to FIG. 9, the container body has a frangible component integrated therewith, as described herein.

At step 910, the container body for an environmentally friendly container with the integrated frangible component is provided. That is, the container body has the frangible component permanently coupled thereto, as described in greater detail herein. For example, the frangible component may be permanently attached to an exterior surface of the container, a frangible component and an exterior barrier may be formed as a single piece, or the frangible component may be formed between exterior and interior barriers of the container, as described herein.

At step 920, the container body is filled with the contents as described herein and at step 930 the closure is provided. At step 940, the closure is secured on the container body and the frangible component is attached to the closure. For example, as described herein, the frangible component may be attached to an exterior surface of the closure or an interior surface of the closure.

Figure 10:
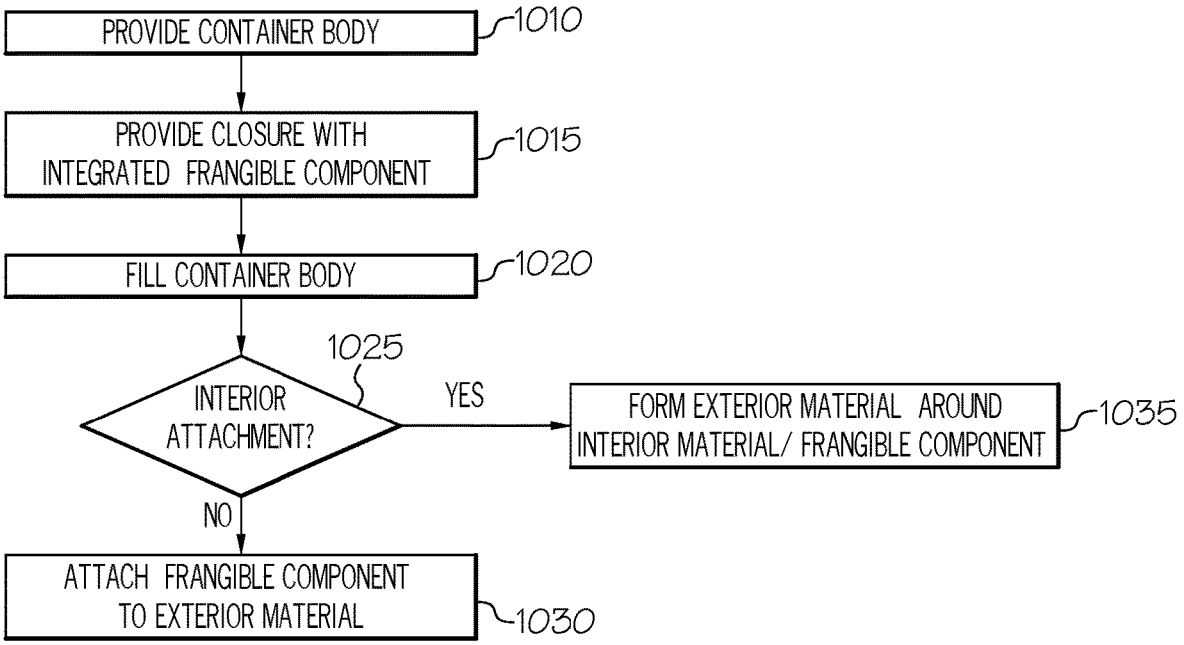
FIG. 10 depicts a flow diagram of a third illustrative method of forming and filling an environmentally friendly tamper resistant container according to one or more embodiments shown and described herein.

FIG. 10 depicts a flow diagram of a third illustrative method of forming and filling an environmentally friendly tamper resistant container according to one or more embodiments shown and described herein. In the steps described with respect to FIG. 10, the closure has a frangible component permanently attached thereto. At step 1010, the container body is provided. In some embodiments, the container body may be provided without being fully formed. That is, the container body provided according to step 1010 may only include a portion thereof, such as the interior barrier or the like.

At step 1015, the closure with an integrated frangible component may be provided. The closure may be any one of the closures described herein that has the frangible component permanently attached thereto. Thus, the closure that is provided at step 830 may be a closure that has a frangible component attached to an outside surface thereof, a frangible component attached to an inside surface thereof, or a closure that is formed as a single piece with the frangible component, as described herein.

At step 1020, the container body may be filled, and at step 1025 a determination may be made as to whether interior attachment of a portion of the frangible component will be completed. That is, a determination may be made as to whether the container-contacting portion of the frangible component will be attached to the exterior surface of the container body or if the container-contacting portion will be attached between the interior barrier and the exterior barrier. Such a determination may be made based on, for example, whether the body provided at step 1010 is a fully assembled container body or only a portion thereof, such as just the interior barrier portion.

If the container-contacting portion of the frangible component is to be attached to an exterior surface of the container body, the frangible component may be so attached at step 1030. For example, the frangible component may be attached via adhesives or the like.

If the container-contacting portion of the frangible component is to be attached to an interior surface of the container body, such as between the interior barrier and the exterior barrier, the frangible component may be placed on an exterior surface of the interior barrier or an interior surface of the exterior barrier prior to formation of the combined exterior and interior barriers together. For example, the container-contacting portion of the frangible component may be placed on an exterior surface of the interior barrier, the exterior material that forms the exterior barrier may be placed thereover (as well as around the remainder of the interior barrier), and the interior barrier may be blow molded to a particular shape, thereby creating a tight fit inside the exterior barrier and ensuring that the container-contacting end of the frangible component remains securably retained between the interior barrier and the exterior barrier.

As a result of the flowcharts completed according any one of the methods described with respect to FIGS. 8-10, the container is now sealed with the closure and provided with an indicator of tampering by the attached frangible component. That is, if removal of the closure after this point is attempted, at least a portion of the frangible component, the closure, and/or the container body will be irreversibly damaged, as described in greater detail herein.

Accordingly, it should now be understood that the tamper resistant features and methods described herein provide a tamper resistant system that includes an environmentally friendly container, a closure, and a frangible component. The frangible component extends from the closure to the container when the container is closed with the closure. The frangible component becomes irreversibly damaged if the closure is subsequently removed from the container. Portions of the closure and/or the container may also become irreversibly damaged in addition or as an alternative to the frangible component. Any one of the container, the closure, and the frangible component, as well as portions/components thereof, may be constructed of an environmentally friendly material. This provides a user with indication that the environmentally friendly container has not been tampered.

Previous solutions to not provide tamper resistance for such environmentally friendly containers, which provide challenges due to the typical nature and integrity of many environmentally friendly materials (e.g. easily torn, easily degraded, etc.). Additionally, embodiments provided herein create greater assurance of tamper resistance due to the one-piece construction, the notch, and the frangible material that previous solutions do not provide.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein.

It should now be understood that embodiments disclosed herein includes systems, and methods for a tamper resistant container. It should also be understood that these embodiments are merely exemplary and are not intended to limit the scope of this disclosure.

What is claimed is:

1. A device comprising:

a frangible component having a first end and a second end, the first end being integrated with a container body such that the frangible component and the container body have a single piece construction, the frangible component extending from the container body, and the second end coupled to a threaded closure when the threaded closure is secured on the container body, wherein:

subsequent removal of the threaded closure from the container body causes irreversible damage to at least one of the frangible component, the threaded closure, and the container body;

the frangible component is constructed of an environmentally friendly material;

the first end of the frangible component is coupled to a notch formed from the container body, wherein the notch comprises a flanged end that prevents removal of the first end of the frangible component therefrom;

the container body comprises an external barrier and an internal barrier formed of a different material than the external barrier;

the notch extends from the external barrier of the container body; and the frangible component is integrated with the external barrier such that the frangible component and the external barrier have a single piece construction, wherein the irreversible damage is a separation of the notch from the container body.

2. The device of claim 1, wherein the second end of the frangible component is coupled to the threaded closure between a threaded surface of the threaded closure and a threaded opening on the container body such that engagement of the threaded closure with the threaded opening retain the second end of the frangible component.

3. The device of claim 1, wherein the second end of the frangible component is coupled to an exterior surface of the threaded closure.

4. The device of claim 1, wherein the irreversible damage is a tear in the frangible component that results in the first end being separated from the second end.

5. A device comprising:

a frangible component having a first end and a second end, the first end being integrated with a threaded closure such that the frangible component and the threaded closure have a single piece construction, the frangible component extending from the threaded closure, and the second end coupled to a container body when the threaded closure is secured on the container body, wherein:

subsequent removal of the threaded closure from the container body causes irreversible damage to at least one of the frangible component, the threaded closure, and the container body;

the frangible component is constructed of an environmentally friendly material comprising sugarcane, bamboo, wheat straw, banana leaves, hay, grasses, cornstalks, or recycled pulp;

the second end of the frangible component is coupled to a notch formed from the container body, wherein the notch comprises a flanged end that prevents removal of the second end of the frangible component therefrom;

the container body comprises an external barrier and an internal barrier formed of a different material than the external barrier; and the notch extends from the internal barrier of the container body through the external barrier of the container body.

6. The device of claim 5, wherein the irreversible damage is a separation of the notch from the container body.

7. The device of claim 5, wherein the second end of the frangible component is coupled to the container body between the internal barrier of the container body and the external barrier of the container body.

8. The device of claim 5, wherein the second end of the frangible component is coupled to an exterior surface the container body.

9. The device of claim 5, wherein the irreversible damage is a tear in the frangible component that results in the first end being separated from the second end.

10. A system comprising:

a container comprising a container body defining a cavity with a threaded opening;

a threaded closure removably covering the threaded opening; and a frangible component comprising a length of material having a first end and a second end, the first end being integrated with the container body such that the frangible component and the container body have a single piece construction, the frangible component extending from the container body, and the second end coupled to the threaded closure, wherein:

subsequent removal of the threaded closure from the container causes damage to at least one of the frangible component, the threaded closure, and the container body;

at least one of the frangible component, the threaded closure, and the container body are at least partially constructed of degradable fiber material;

the first end of the frangible component is coupled to a notch formed from the container body, wherein the notch comprises a flanged end that prevents removal of the first end of the frangible component therefrom;

the container body comprises an external barrier and an internal barrier formed of a different material than the external barrier;

the notch extends from one of the external barrier and the internal barrier; and the frangible component is integrated with the external barrier such that the frangible component and the exterior barrier have a single piece construction, wherein the notch extends from the internal barrier of the container body through the external barrier of the container body.

11. The system of claim 10, wherein the notch extends from the external barrier.

* * * * *